US009283793B2

(12) United States Patent
Ikeda et al.

(10) Patent No.: US 9,283,793 B2
(45) Date of Patent: Mar. 15, 2016

(54) THERMOSENSITIVE RECORDING LABEL

(71) Applicants: Toshiaki Ikeda, Shizuoka (JP); Yutaka Kuga, Shizuoka (JP); Tomoyuki Kugoh, Shizuoka (JP)

(72) Inventors: Toshiaki Ikeda, Shizuoka (JP); Yutaka Kuga, Shizuoka (JP); Tomoyuki Kugoh, Shizuoka (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 14/234,249

(22) PCT Filed: Oct. 30, 2012

(86) PCT No.: PCT/JP2012/078556

§ 371 (c)(1),
(2) Date: Jan. 22, 2014

(87) PCT Pub. No.: WO2013/069581

PCT Pub. Date: May 16, 2013

(65) Prior Publication Data

US 2014/0234558 A1 Aug. 21, 2014

(30) Foreign Application Priority Data

Nov. 7, 2011 (JP) ..... 2011-243031
Mar. 22, 2012 (JP) ..... 2012-065051

(51) Int. Cl.

| | |
|---|---|
| ***B41M 5/42*** | (2006.01) |
| ***B41M 5/44*** | (2006.01) |
| ***G09F 3/10*** | (2006.01) |
| *G09F 3/02* | (2006.01) |

(52) U.S. Cl.

CPC ..... *B41M 5/443* (2013.01); *B41M 5/42* (2013.01); *B41M 5/426* (2013.01); *B41M 5/44* (2013.01); *G09F 3/10* (2013.01); *B41M 2205/04* (2013.01); *B41M 2205/32* (2013.01); *B41M 2205/34* (2013.01); *B41M 2205/36* (2013.01); *B41M 2205/38* (2013.01); *B41M 2205/40* (2013.01); *G09F 2003/0211* (2013.01)

(58) Field of Classification Search

CPC ..... B41M 5/42; B41M 5/426; B41M 5/44; B41M 5/443; B41M 2205/04; B41M 2205/34; B41M 2205/36; B41M 2205/38; B41M 2205/40; G02F 2003/0211

USPC ..... 503/200–226

See application file for complete search history.

(56) References Cited

U.S. PATENT DOCUMENTS

| | | | |
|---|---|---|---|
| 4,851,383 | A | 7/1989 | Fickenscher et al. |
| 5,508,247 | A | 4/1996 | Tran et al. |
| 5,977,021 | A | 11/1999 | Aoyama et al. |
| 6,828,017 | B2 | 12/2004 | Kugo et al. |
| 7,993,732 | B2 | 8/2011 | Sasaki et al. |
| 2003/0175507 | A1 | 9/2003 | Ikeda et al. |
| 2004/0043236 | A1 | 3/2004 | Kugo et al. |
| 2006/0141146 | A1 | 6/2006 | Kugo et al. |
| 2008/0176012 | A1 | 7/2008 | Morita et al. |
| 2008/0234128 | A1 | 9/2008 | Orihara et al. |
| 2009/0017299 | A1 | 1/2009 | Shimbo et al. |
| 2009/0130441 | A1 | 5/2009 | Kuga et al. |
| 2009/0155569 | A1 | 6/2009 | Yamaguchi et al. |

FOREIGN PATENT DOCUMENTS

| | | |
|---|---|---|
| JP | 10181200 | 7/1998 |
| JP | 10193791 | 7/1998 |
| JP | 10-315621 | 12/1998 |
| JP | 11-116909 | 4/1999 |
| JP | 2001-066991 | 3/2001 |
| JP | 2003-034076 | 2/2003 |
| JP | 2003-171630 | 6/2003 |
| JP | 2005-002313 | 1/2005 |
| JP | 2008-231171 | 10/2008 |
| JP | 2008-260275 | 10/2008 |
| JP | 4409809 | 11/2009 |

OTHER PUBLICATIONS

International Search Report Issued for counterpart International Patent Application No. PCT/JP2012/078556 dated Dec. 25, 2012.
European search report dated May 7, 2015 in corresponding. European Patent Application No. 12848388.

*Primary Examiner* — Bruce H Hess
(74) *Attorney, Agent, or Firm* — Cooper & Dunham LLP

(57) ABSTRACT

To provide a thermosensitive recording label, which contains a base, an under layer, a thermosensitive coloring layer, a barrier layer, a release layer, and an adhesive layer, where the under layer, the thermosensitive coloring layer, the barrier layer, and the release layer are disposed on one surface of the base in this order, and the adhesive layer is disposed on the other surface of the base, wherein the release layer contains a cured product of a heat curing silicone resin, and the barrier layer contains a cured product of a water-soluble resin with a crosslinking agent, and inorganic filler.

11 Claims, No Drawings

THERMOSENSITIVE RECORDING LABEL

TECHNICAL FIELD

The present invention relates to a thermosensitive recording label without release paper (liner-less thermosensitive recording label) used with a printer equipped with a thermal heat, which colors a thermosensitive coloring layer with heat in the so fields of printers for computer output or calculator, recorders for medical instrumentation, low-speed or high speed facsimiles, automatic ticket, machines, thermosensitive copying, handy terminals, and labels such as POS system.

BACKGROUND ART

Use of an adhesive sheet for a label having a thermosensitive coloring layer has been increased in recent years as for labels for displaying prices, labels for displaying product information (barcode), labels for displaying quality of products, labels for displaying measurements, labels for advertising (stickers), or the like. As for a recording method thereof, there are inkjet recording, thermosensitive recording, and pressure sensitive recording. Conventionally, a typical adhesive sheet for a label, which has a laminate structure where an adhesive layer and release paper are laminated on an opposite surface of the sheet to a thermosensitive coloring layer, can be used also in the rolled state, as the adhesive layer and the thermosensitive coloring layer are brought into a contact via the release paper. Moreover, the adhesive sheet for a label is widely used because it is easily adhered by peeling the release paper to expose the adhesive layer at the time of adhering.

However, this conventional adhesive sheet for a label requires peeling the release paper upon use. As it is difficult to reuse the release paper as peeled, it is disposed in most cases, which leads to wasting of natural resources.

To solve the aforementioned problem, proposed is a rolled liner-less thermosensitive recording label, which has a release layer formed on a surface of the thermosensitive coloring layer, and having releasing property against the adhesive layer, and thus can used in the state of a roll without the release paper.

This liner-less thermosensitive recording label, however, has the release layer on the surface of the thermosensitive coloring layer, and therefore the release layer is adhered (stacked) on a thermal head as printed by means of a printer equipped with the thermal head, causing a problem that printing cannot be performed adequately. Therefore, there have been needs for a thermosensitive recording label, with which printing can be performed adequately, and in which the adhesive layer and the release layer can be appropriately released from each other.

In order to prevent adhesion between a thermosensitive recording label and a thermal head, and prevent deposition of a release layer forming material onto a thermal head, for example, proposed is heating a release layer forming material (e.g., an emulsion type silicone resin, zinc stearate emulsion, and colloidal silica) with a curing catalyst to sufficiently cure (see PTL 1). In this proposal, however, matching ability of a resulting label to a thermal head is not necessarily adequate. Moreover, as the release layer contains zinc stearate, it is difficult to cure the silicone resin, causing reduction in release ability of the release layer.

Further, proposed is a thermosensitive recording label, in which a thermosensitive coloring layer, a protective layer, and a release layer are laminated, where the protective layer contain a powder having a particle diameter of 0.01 μm to 10 μm to form irregular shapes on a surface of the release layer, to thereby prevent adhesion between a thermal head and the label (see PTL 2). In this proposal, however, a resin for forming the release layer is a UV curing silicone resin, which causes volume shrinkage during UV curing, resulting in low binding ability between the release layer and the protective layer.

Moreover, proposed is to improve curing ability of a release layer formed by curing polysiloxane containing an epoxy group, polysiloxane containing a 1-propenyl ether group, and polysiloxane containing a vinyl ether group by applying radioactive rays, and to improve close contactness between a protective layer and the release layer, using the protective layer containing a water-soluble resin and colloidal silica as main components (see PTL 3). However, this proposal cannot prevent volume shrinkage during UV curing, which leads to a problem that anti sticking property of the release layer is low.

Moreover, proposed is a thermosensitive recording adhesive label containing a release layer formed by curing a material containing a solventless radioactive ray curing organopolysiloxane compound and organohydrogen polysiloxane by application of radioactive rays (see PTL 4). In this proposal, however, the solventless silicone resin has a small molecular weight compared to that of a solvent silicone resin and tends to result insufficient curing bonds. A crosslink reaction proceeds quickly in radioactive ray curing to form a cured coating film within a few seconds. Therefore, ═SiH groups tend to remain and crosslink density becomes low, which may cause sticking.

Proposed is release paper having a release layer formed by heat curing a solventless silicone resin (see PTL 5). This proposal, however, does not aim to prevent sticking, and to improve binding ability with a barrier layer.

Further, proposed is a thermosensitive recording material, which contains a base, a thermosensitive coloring layer containing a leuco dye and a developing agent, a first protective layer containing a water-soluble resin and a crosslinking agent, and a second protective layer containing a water-soluble resin, a crosslinking agent, and a pigment, where the thermosensitive coloring layer, the first protective layer, and the second protective layer are laminated on the base in this order, and the second protective layer contains diacetone-modified polyvinyl alcohol, and an acrylic resin or maleic copolymer (see PTL 6). In this proposal, however, the protective layer is the outer surface layer, and it does not teach about compatibility with a release layer formed of a solventless silicone resin provided the outermost surface.

As mentioned above, the liner-less thermosensitive recording labels described in the conventional art have problems that a sufficient binding strength between the protective layer and the release layer cannot be obtained, and both anti-sticking property and sufficient release ability of the release layer to the adhesive layer cannot be obtained at the same time.

CITATION LIST

Patent Literature

PTL 1: Japanese Patent (JP-B) No. 4409809
PTL 2: Japanese Patent Application Laid-Open (JP-A) No. 2003-34076
PTL 3: JP-A No. 11-116909
PTL 4: JP-A No. 2003-171630
PTL 5: JP-A No. 2008-231171
PTL 6: JP-A No. 2008-260275

SUMMARY OF INVENTION

Technical Problem

The present invention aims to provide a thermosensitive recording label, which is releasable without causing blocking between a release layer provided on a surface of the thermosensitive recording label and an adhesive layer provided on a back surface thereof, when it is mounted in a shape of a roll without release paper, which prevents sticking between the thermosensitive recording label and a thermal head, and prevents sticking of a material for forming the release layer as printed by a thermal printer, and which does not lower its coloring sensitivity lowing of which is generally caused by providing a release layer.

Solution to Problem

As a result of the diligent researches and studies conducted by the present inventors to solve the aforementioned problems, it has been found that a combination of a certain release layer and a certain barrier layer can solve the aforementioned problems. Specifically, a thermosensitive recording label contains: a base; an under layer; a thermosensitive coloring layer; a harrier layer; a release layer; and an adhesive layer, where the under layer, the thermosensitive coloring layer, the barrier layer, and the release layer are disposed on one surface of the base in this order, and the adhesive layer is disposed on the other surface of the base, wherein the release layer contains a cured product of a heat curing silicone resin, and the barrier layer contains a cured product of a water-soluble resin with a crosslinking agent, and inorganic filler. With such thermosensitive recording label, the following insights have been found. The high curing ability is exhibited during formation of the release layer even when a heat value for heat curing the heat curing silicone resin is educed, and moreover the heat curing silicone resin has a small degree of volume shrinkage. Therefore, binding ability between the release layer and the barrier layer after heat curing the silicone resin improves, which lead to improvement in releasability between the release layer and the binder layer when the thermosensitive recording label is in a form of a roll. As a result of the improvement in the binding ability between the release layer and the barrier layer, moreover, the thermosensitive recording label improves conveyance properties in high temperature high humidity environments, and anti-sticking properties in low temperature low humidity environment, as printed with a thermal head.

The thermosensitive recording label of the present invention, which is the mean of the aforementioned problems, includes:

a base;

an under layer;

a thermosensitive coloring layer;

a barrier layer;

a release layer; and an adhesive layer, where the under layer, the thermosensitive coloring layer, the barrier layer, and the release layer are disposed on one surface of the base in this order, and the adhesive layer is disposed on the other surface of the base, wherein the release layer contains a cured product of a heat curing silicone resin, and the barrier layer contains a cured product of a water-soluble resin with a crosslinking agent, and inorganic filler.

Advantageous Effects of Invention

The present invention can solve the aforementioned various problems in the conventional art, achieve the aforementioned object, and provide a thermosensitive recording label, which is releasable without causing blocking between a release layer provided on a surface of the thermosensitive recording label and an adhesive layer provided on a back surface thereof, when it is mounted in a shape of a roll without release paper, which prevents sticking between the thermosensitive recording label and a thermal head, and prevents sticking of a material for forming the release layer as printed by a thermal printer, and which does not lower its coloring sensitivity lowing of which is generally caused by providing a release layer.

DESCRIPTION OF EMBODIMENTS

Thermosensitive Recording Label

The thermosensitive recording label of the present invention contains a base, an under layer, a thermosensitive coloring layer, a barrier layer, a release layer, and an adhesive layer, where the under layer, the thermosensitive coloring layer, the barrier layer, and the release layer are disposed in this order on one surface of the base, and the adhesive layer is disposed on the other surface of the base. The thermosensitive recording label of the present invention may further contain other layers, if necessary.

<Release Layer>

The release layer contains a cured product of a heat curing silicone resin, and may further contain other components, if necessary.

-Cured Product of Heat Curing Silicone Resin-

The cured product of the heat curing silicone resin can be appropriately selected without any limitation, but it preferably contains an addition reaction curable silicone resin and a crosslinking agent as by-products are not generated after curing.

---Addition Reaction Curable Silicone Resin---

The addition reaction curable silicone resin can be appropriately selected without any limitation, but it is preferably organosiloxane containing a vinyl group, a mercapto group, an epoxy group, a methacryl group, a maleimide group, a methacryl amide group, a thioacryl group, or a hexenyl group at a side chain of a silicon bond (—Si—) of siloxane, in view of peel force, safety, hazard, and cost. More preferred is organopolysiloxane containing a hexenyl group at a side chain of a silicon bond (—Si—) of siloxane, in view of initial bonding strength of the adhesive layer and the release layer.

---Crosslinking Agent---

The crosslinking agent can be appropriately selected without any limitation, but it is preferably organohydrogen siloxane in view of reactivity to the addition reaction curable silicone resin. Note that, the organohydrogen polysiloxane is a compound containing a reactive silicon (═SiH) at least either at a terminal of a principle chain or at a terminal of side chain of a molecule thereof.

Especially when the thermosensitive recording label is formed into a roll, a problem occurs such that bonding strength between the adhesive layer and the release layer increases over time.

The cause of the aforementioned problem includes bonding of a reactive silicon (═SiH) remained in the organohydrogen polysiloxane due to insufficient crosslink of the release layer, with a carboxyl group (—COOH) of polyacrylic acid or the like contained in the adhesive layer.

Use of organopolysiloxane having a hexenyl group, which hardly cause steric hindrance during a crosslink reaction enables to increase reactivity with the reactive silicone (═SiH) in organohydrogen polysiloxane, to thereby reduce the reactive silicone (═SiH) remained.

Typically, a crosslink reaction is induced by irradiation of radioactive rays, but the addition reaction curable silicone resin can be subjected to a crosslink reaction by heat applied during a drying process by adding a catalyst thereto.

Curing performed by UV radiation is difficult to affect evenly on a silicone resin. When curing is partially insufficient, initially performance of a resultant may be excellent, but a resistance at the time of peeling may increase as time passes. On the other hand, heat curing can be performed evenly, and stably, and therefore peel force is excellent over time.

The release layer is appropriately selected depending on the intended purpose without any limitation, but it is preferably cured with heat at 90° C. to 110° C. in order to prevent coloring of a thermosensitive coloring layer, and it preferably contains a catalyst to sufficiently perform crosslink curing in the aforementioned temperature range.

The catalyst is appropriately selected depending on the intended purpose without any limitation, and examples thereof include organic acid metal salts, 1,3-diketone metal complex salt, metal alkoxide, and platinum.

Among them, platinum is preferable because it hardly inhibits a curing reaction.

The organic acid metal salt is appropriately selected depending on the intended purpose without any limitation, and examples thereof include dibutyl tin dilaurate, dibutyl tin maleate, zinc 2-ethylhexanoate.

The 1,3-diketone metal complex salt is appropriately selected depending on the intended purpose without any limitation, and examples thereof include nickel acetylacetonate, and zinc acetylacetonate.

The metal alkoxide is appropriately selected depending on the intended purpose without any limitation, and examples thereof include titanium tetrabutoxide, and zirconium tetrabutoxide.

An amount of the catalyst is appropriately selected depending on the intended purpose without any limitation, but it is preferably 2.5 parts by mass to 4 parts by mass, relative to 100 parts by mass of the resin component. When the amount thereof is smaller than 2.5 parts by mass, the resin may not be sufficiently cured.

<Barrier Layer>

The barrier layer contains a cured product of a water-soluble resin with a crosslinking agent, and inorganic filler, preferably further contains resin particles, and may further contain other components, if necessary.

The barrier layer has both a function of protecting an image, and a function of improving bonding strength with the release layer.

-Water-Soluble Resin-

The water-soluble resin is appropriately selected depending on the intended purpose without any limitation, provided that it is a resin dissolved in an amount of 3 g or greater in 100 g of water of 25° C. Examples of the water-soluble resin include water-soluble polymers, such as polyvinyl alcohol, starch and derivatives thereof, cellulose derivatives (e.g., methoxy cellulose, hydroxyethyl cellulose, and carboxymethyl cellulose), sodium polyacrylate, polyvinyl pyrrolidone, alkali salt of a styrene-maleic anhydride copolymer, alkali salt of an isobutylene-maleic anhydride copolymer, polyacryl amide, gelatine, and casein.

The weight average molecular weight of the water-soluble polymer is appropriately selected depending on the intended purpose without any limitation, provided that it is in the range of 5,000 to 300,000, but it is preferably 10,000 to 200,000 in view of bonding strength.

Among them, the water-soluble resin is preferably a resin that is hardly dissolved or softened by heat, and has high heat resistance, in view of preventing the aforementioned problem associated with sticking. Specifically, preferred is polyvinyl alcohol containing a reactive carbonyl group, more preferred are diacetone-modified polyvinyl alcohol and itaconic acid-modified polyvinyl alcohol, and particularly preferred is itaconic acid-modified polyvinyl alcohol.

An amount of the diacetone group in the diacetone-modified polyvinyl alcohol is appropriately selected depending on the intended purpose without any limitation, but it is preferably 0.5 mol % to 20 mol % relative to the entire polymer, more preferably 2 mol % to 10 mol % in view of water resistance. When the amount thereof is smaller than 0.5 mol %, water resistance may be insufficient for practical use. When the amount thereof is greater than 20 mol %, further improvement in water resistance may not be expected, and use in such amount is economically disadvantageous in view of its high cost.

The polymerization degree of the diacetone-modified polyvinyl alcohol is appropriately selected depending on the intended purpose without any limitation, but it is preferably 300 to 3,000, more preferably 500 to 2,200. Moreover, the saponification degree of the di acetone-modified polyvinyl alcohol is preferably 80% or more.

-Crosslinking Agent-

The crosslinking agent is appropriately selected depending on the intended purpose without any limitation, and examples thereof include a polyvalent amine compound, a polyvalent aldehyde compound, a dihydrazide compound, a water-soluble methylol compound, a polyfunctional epoxy compound, polyvalent metal salt, boric acid, and titanium lactate. These may be used in combination with any other conventional crosslinking agents.

The polyvalent amine compound is appropriately selected depending on the intended purpose without any limitation, and examples thereof include ethylene diamine.

The polyvalent aldehyde compound is appropriately selected depending on the intended purpose without any limitation, and examples thereof include glyoxal, glutar aldehyde, and dialdehyde.

The dihydrazide compound is appropriately selected depending on the intended purpose without any limitation, and examples thereof include adipic acid dihydrazide, and phthalic acid dihydrazide.

The water-soluble methylol compound is appropriately selected depending on the intended purpose without any limitation, and examples thereof include urea, melamine, and phenol.

Examples of a quantitative method of the cured product of the water-soluble resin with crosslinking agent include HS-GC/MS, and CP/MAS.

An amount of the cured product of the water-soluble resin with the crosslinking agent in the barrier layer can be appropriately selected without any limitation, but it is preferably 5% by mass to 20% by mass.

-Inorganic Filler-

The inorganic filler is appropriately selected depending on the intended purpose without any limitation, and examples thereof include inorganic powder, such as aluminum hydroxide, calcium carbonate, silica, zinc oxide, titanium oxide, zinc hydroxide, barium sulfate, clay, talc, thermally surface treated calcium, thermally surface treated silica, and thermally surface treated kaolin.

Among them, aluminum hydroxide is preferable because it contributes to provide preferable bonding strength between the barrier layer and the release layer, and to provide abrasion resistance to the thermosensitive recording label against a thermal head, when printing is performed over a long period, through there is no direct contact between the barrier layer and the thermal heat.

The average particle diameter of the inorganic filler is appropriately selected depending on the intended purpose without any limitation, but it is preferably 0.1 μm to 2 μm, in view of sensitivity of a resulting thermosensitive recording label.

-Resin Particles-

The resin particles are appropriately selected depending on the intended purpose without any limitation, but they are preferably either silicone resin particles, or crosslinked polymethyl methacrylate particles.

Use of resin particles in combination with the inorganic filler leads to further improvement in abrasion resistance, binding ability with the release layer, and releasability between the release layer and the adhesive layer.

--Silicone Resin Particles--

Use of silicone resin particles leads to further improvement in abrasion resistance, binding ability with release layer, and releasability between the release layer and the adhesive layer.

The silicone resin particles are particles formed by dispersing and curing a silicone resin into fine powder, and include those composed of spherical particles and those composed of irregularly-shaped particles, but the silicone resin particles are preferably spherical particles.

As a silicone resin of the silicone resin particles, a polymer of a three-dimensional network structure, having a siloxane bond in its principle chain can be used. As well as those having a methyl group in its side chain, those having a phenyl group, a carboxyl group, a vinyl group, a nitrile group, an alkoxy group, or chloride atom can be widely applied. The powder of the cured product using the polymer of the three dimensional network structure, which has a siloxane bond in its principle chain, is excellent in dispersibility, and heat resistance, and does not swell or dissolve with an organic solvent.

An amount of the silicone resin particles in the barrier layer is appropriately selected depending on the intended purpose without any limitation, but it is preferably 10 parts by mass to 80 parts by mass, relative to 100 parts by mass of the water-soluble resin.

--Crosslinked Polymethyl Methacrylate Particles--

The crosslinked polymethyl methacrylate particles are typically particles formed by bonding a linear polymer of polymethyl methacrylate in the three-dimensional network structure as a result of a reaction between methyl methacrylate, a divinyl compound, and a radical initiator to initiate radical polymerization. Such crosslink structure gives polymethyl methacrylate a high softening point.

An analysis method for the polymethyl methacrylate includes, for example, $^{1}$H-NMR, and $^{13}$C-NMR.

Examples of an analysis method for the crosslink structure include those methods used for the polymethyl methacrylate.

The crosslinked polymethyl methacrylate particles can increase bonding strength between the barrier layer and the release layer, and prevent a problem that printing cannot be performed adequately because a releasing material in the release layer is deposited on a thermal head when printing is performed by means of a printer having the thermal head.

The structure of each crosslinked polymethyl methacrylate particle can be appropriately selected depending on the intended purpose without any limitation, but it is preferably porous in view of bonding strength between the release layer and the barrier layer.

The porosity is appropriately selected depending on the intended purpose without any limitation, but it is preferably bulk density of 0.45 g/mL to 1.00 g/mL.

A measurement method of the bulk density includes, for example, a method in which the crosslinked polymethyl methacrylate particles to be measured are added to a measuring cylinder to measure a volume and mass thereof, and (measured mass/measured volume) is calculated to determine the bulk density.

The volume average particle diameter of the crosslinked polymethyl methacrylate particles is appropriately selected depending on the intended purpose without any limitation, but it is preferably 1.0 μm to 8.0 μm. When the volume average particle diameter thereof is smaller than 1.0 μm, an effect of so preventing sticking during printing using a printer having a thermal head is lowered. When the volume average particle diameter thereof is greater than 8.0 μm, the degree of close contact between the thermal head and the thermosensitive coloring layer is lowered to reduce coloring sensitivity.

Examples of the measurement method of the volume average particle diameter include a method using a laser scattering/diffraction particle sizer.

An amount of the crosslinked polymethyl methacrylate particles in the barrier layer is appropriately selected depending on the intended purpose without any limitation, but it is preferably 25 parts by mass to 100 parts by mass relative to 100 parts by mass of the water-soluble resin. When the amount of the crosslinked polymethyl methacrylate particles is smaller than 25 parts by mass, an effect of the crosslinked polymethyl methacrylate particles to inhibit sticking may be insufficient. When the amount thereof is greater than 100 parts by mass, the barrier layer may conceal the thermosensitive coloring layer to thereby lower an effect of preventing reduction of image density.

<Under Layer>

The under layer is appropriately selected depending on the intended purpose without any limitation, but it is preferred that the under layer contain an adhesive resin, and filler, and may further contain other components, if necessary.

-Binder Resin-

The binder resin is appropriately selected depending on the intended purpose without any limitation, and examples thereof include: water-soluble polymers such as a styrene-butadiene copolymer, polyvinyl alcohol, various modified polyvinyl alcohol, starch and derivatives thereof, cellulose derivatives (e.g., hydroxymethyl cellulose, hydroxyethyl cellulose, carboxymethyl cellulose, methyl cellulose, and ethyl cellulose), sodium polyacrylate, polyvinyl pyrrolidone, an acryl amide/acrylic acid ester copolymer, an acryl amide-acrylic acid ester-methacryl acid terpolymer, an alkali salt of a styrene-maleic anhydride copolymer, an alkali salt of an isobutylene-maleic anhydride copolymer, polyacryl amide, sodium alginate, gelatine, and casein; and emulsion such as polyvinyl acetate, polyurethane, polyacrylic acid, polyacrylate, a vinyl chloride-vinyl acetate copolymer, polybutyl methacrylate, an ethylene-vinyl acetate copolymer. These may be used independently or in combination.

-Filler-

The filler is appropriately selected without any limitation, and examples thereof include inorganic filler, and organic filler.

--Inorganic Filler--

The inorganic filler is appropriately selected without any limitation, and examples thereof include those usable in the barrier layer.

--Organic Filler--

The organic filler is appropriately selected without any limitation, but it is preferably hollow thermoplastic resin particles in view of heat retentiveness.

---Hollow Thermoplastic Resin Particles---

The hollow thermoplastic resin particles are appropriately selected depending on the intended purpose without any limitation, but particles, each of which contains a shell of a thermoplastic resin, and encapsulates a gas such as air, are preferable.

The term "hollow" typically means a structure where an article has a void inside, and is specifically a structure having at least either a space in which gas such as air can be encapsulated, or a hole through which gas such as air can be passed through all the time.

----Thermoplastic Resin----

The thermoplastic resin is appropriately selected depending on the intended purpose without any limitation, and examples thereof include a styrene-acryl resin, a polystyrene resin, an acrylic resin, a polyethylene resin, a polypropylene resin, a polyacetal resin, a chlorinated polyether resin, a polyvinyl chloride resin, a vinylidene chloride-acrylonitrile copolymer resin, a phenol-formaldehyde resin, a urea-formaldehyde resin, a melamine-formaldehyde resin, a furan resin, an unsaturated polyester resin, and a crosslinked MMA resin. These may be used independently or in combination.

Among them, a styrene-acryl resin and a copolymer mainly composed of vinylidene chloride and acrylonitrile are preferable because they can give a high void ratio, and less variation in the average particle diameter thereof, which are suitable for blade coating.

The volume average particle diameter (outer particle diameter) of the hollow thermoplastic resin particles is appropriately selected depending on the intended purpose without any limitation, but it is preferably 0.2 μm to 20 μm, more preferably 2 μm to 5 μm. When the volume average particle diameter is smaller than 0.2 μm, it is technically difficult to make particles hollow, and therefore the under layer may not exhibit its function sufficiently. When the volume average particle diameter thereof is greater than 20 μm, smoothness of the surface after coating and drying may be degraded, and therefore the thermosensitive coloring layer may not be coated evenly. Accordingly, it is preferred that the hollow thermoplastic resin particles have uniform particle distribution peak without variation, as well as having the volume average particle diameter in the aforementioned range.

A measurement method of the volume average particle diameter includes, for examples, those methods used for measuring the volume average particle diameter of the crosslinked polymethyl methacrylate particles.

A void ratio of the hollow thermoplastic resin particles is appropriately selected depending on the intended purpose without any limitation, but it is preferably 30% to 95%, more preferably 80% to 95%, in view of heat retentiveness. When the void ratio is less than 30%, the thermal insulating properties of the under layer is insufficient, and therefore heat energy from a thermal head is released outside of a thermosensitive recording material through base. As a result, an effect of improving sensitivity of the thermosensitive recording material may be insufficient.

Examples of a measurement method of the void ratio include a method using a scanning electron microscope (SEM).

Note that, the void ratio is a ratio between the outer diameter and inner diameter (diameter of a void part) of the hollow thermoplastic resin particle, and can be represented by the following equation (1).

$$\text{Void ratio}=(\text{inner diameter of hollow thermoplastic resin particle}/\text{outer diameter of hollow thermoplastic resin particle})\times 100 \qquad \text{Equation (1)}$$

An amount of the hollow thermoplastic resin particles in the under layer is appropriately selected depending on the intended purpose without any limitation, but it is preferably 1.0 g/m$^2$ to 3.0 g/m$^2$ in order to maintain sensitivity and evenness in coating. When the amount of the hollow thermoplastic resin particles is less than 1.0 g/m$^2$, sufficient sensitivity may not be attained. When the amount thereof is more than 3.0 g/m$^2$, bonding strength of the under layer may be lowered.

<<Bonding Strength>>

The bonding strength between the release layer and the barrier layer is appropriately selected depending on the intended purpose without any limitation, but it is preferably stronger than the bonding strength between the adhesive layer and the release layer.

Examples of a measuring method of the bonding strength include a method described in JIS P0001.

<Thermosensitive Coloring Layer>

The thermosensitive coloring layer is appropriately selected depending on the intended purpose without any limitation, but the thermosensitive coloring layer contains a leuco dye and a developing agent, and may further contain other components, if necessary.

-Leuco Dye-

The leuco dye can be appropriately selected depending on the intended purpose without any limitation, and examples thereof an electron-donating compound that is per se colorless or pale colored and is a dye precursor, such as triphenylmethane phthalide compounds, triallyl methane compounds, fluoran compounds, phenothiazine compounds, thiofluoran compounds, xanthen compounds, indophthalyl compounds, spiropyran compounds, azaphthalide compounds, chromenopyrazole compounds, methine compounds, rhodamine aniline lactum compounds, rhodamine lactum compounds, quinazoline compounds, diazaxanthen compounds, and bislactone compounds. These may be used independently or in combination.

In view of coloring properties, and quality of an image, in terms of fading in an imaging part due to moisture, heat, and light, and background fogging in a background part, preferred as the leuco dye are 2-anilino-3-methyl-6-diethylaminofluoran, 2-anilino-3-methyl-6-(di-n-butylamino)fluoran, 2-anilino-3-methyl-6-(di-n-pentylamino)fluoran, 2-anilino-3-methyl-6-(N-n-propyl-N-methylamino)fluoran, 2-anilino-3-methyl-6-(N-isopropyl-N-methylamino)fluoran, 2-anilino-3-methyl-6-(N-isobutyl-N-methylamino)fluoran, 2-anilino-3-methyl-6-(N-n-amyl-N-methyl amino)fluoran, 2-anilino-3-methyl-6-(N-sec-butyl-N-ethyl amino)fluoran, 2-anilino-3-methyl-6-(N-n-amyl-N-ethyl amino)fluoran, 2-anilino-3-methyl-6-(N-iso-amyl-N-ethyl amino)fluoran, 2-anilino-3-methyl-6-(N-cyclohexyl-N-methyl amino)fluoran, 2-anilino-3-methyl-6-(N-ethyl-p-toluidino)fluoran, 2-anilino-3-methyl-6-(N-methyl-p-toluidino)fluoran, 2-(m-trichloromethyl anilino)-3-methyl-6-diethyl aminofluoran, 2-(m-trifluoromethyl anilino)-3-methyl-6-diethyl aminofluoran, 2-(m-trifluoromethyl anilino)-3-methyl-6-(N-cyclohexyl-N-methyl amino)fluoran, 2-(2,4-dimethyl anilino)-3-methyl-6-diethyl aminofluoran, 2-(N-ethyl-p-toluidino)-3-methyl-6-(N-ethyl anilino)fluoran, 2-(N-methyl-p-toluidino)-3-methyl-6-(N-propyl-p-toluidino) fluoran, 2-anilino-6-(N-n-hexyl-N-ethyl amino)fluoran, 2-(o-chloranilino)-6-diethyl aminofluoran, 2-(o-bromoanilino)-6-diethyl aminofluoran, 2-(o-chloranilino)-6-dibutylaminofluoran, 2-(o-fluoroanilino)-6-dibutylaminofluoran, 2-(m-trifluoromethyl anilino)-6-diethylaminofluoran, 2-(p-acetylanilino)-6-(N-n-amyl-N-n-butylamino)fluoran, 2-benzylamino-6-(N-ethyl-p-toluidino)fluoran, 2-benzylamino-6-(N-methyl-2,4-dimethyl anilino)fluoran, 2-benzylamino-6-(N-ethyl-2,4-dimethyl anilino)fluoran, 2-dibenzylamino-6-(N-methyl-p-toluidino)fluoran, 2-dibenzylamino-6-(N-ethyl-p-toluidino)fluoran, 2-(di-p-methyl benzylamino)-6-(N-ethyl-p-toluidino)fluoran, 2-(α-phenylethyl amino)-6-(N-ethyl-p-toluidino)fluoran, 2-methyl amino-6-(N-methyl anilino)fluoran, 2-methyl amino-6-(N-ethyl anilino)fluoran, 2-methyl amino-6-(N-propylanilino) fluoran, 2-ethyl amino-6-(N-methyl-p-toluidino)fluoran, 2-methyl amino-6-(N-methyl-2,4-dimethyl anilino)fluoran, 2-ethyl amino-6-(N-methyl-2,4-dimethyl anilino)fluoran, 2-dimethyl amino-6-(N-methyl anilino)fluoran, 2-dimethyl amino-6-(N-ethyl anilino)fluoran, 2-diethyl amino-6-(N-methyl-p-toluidino)fluoran, benzo leuco methylene blue, 2-[3,6-bis(diethyl amino)]-6-(o-chloranilino)xanthyl benzoic acid lactam, 2-[3,6-bis(diethyl amino)]-9-(o-chloranilino)xanthyl benzoic acid lactam, 3,3-bis(p-dimethyl aminophenyl)phthalide, 3,3-bis(p-dimethyl aminophenyl)-6-dimethyl aminophthalide, 3,3-bis(p-dimethyl aminophenyl)-6-diethyl aminophthalide, 3,3-bis(p-dimethyl aminophenyl)-6-chlorphthalide, 3,3-bis(p-dibutylaminophenyl)phthalide, 3-(2-methoxy-4-dimethyl aminophenyl)-3-(2-hydroxy-4,5-dichlorphenyl)phthalide, 3-(2-hydroxy-4-dimethyl aminophenyl)-3-(2-methoxy-5-chlorphenyl)phthalide, 3-(2-hydroxy-4-dimethoxyaminophenyl)-3-(2-methoxy-5-chlorphenyl)phthalide, 3-(2-hydroxy-4-dimethyl a nophenyl)-3-(2-methoxy-5-nitrophenyl)phthalide, 3-(2-hydroxy-4-diethyl aminophenyl)-3-(2 methoxy-5-methyl phenyl)phthalide, 3,6-bis(dimethyl amino)fluorenespiro(9,3')-6'-dimethyl aminophthalide, 6'-chloro-8'-methoxybenzoindolino-spiropyran, and 6'-bromo-2'-methoxybenzoindolino-spiropyran.

An amount of the leuco dye in the thermosensitive coloring layer is appropriately selected depending on the intended purpose without any limitation, but it is preferably 5% by mass to 20% by mass, more preferably 10% by mass to 15% by mass in view of coloring density -Developing Agent- The developing agent is appropriately selected depending on the intended purpose without any limitation. Since various electron-donating materials that react with the leuco dye upon application of heat to color, preferred are bisphenol A, tetrabromo bisphenol A, gallic acid, salicylic acid, 3-isopropyl salicylate, 3-cyclohexyl salicylate, 3,5-di-tert-butyl salicylate, 3,5-di-α-methylbenzyl salicylate, 4,4'-isopropylidenediphenol, 1,1'-isopropylidenebis(2-chlorophenol), 4,4'-isopropylidenebis(2,6-dibromophenol), 4,4'-isopropylidenebis(2,6-dichlorophenol), 4,4'-isopropylidenebis(2-methyl phenol), 4,4'-isopropylidenebis(2,6-dimethyl phenol), 4,4'-isopropylidenebis(2-tert-butylphenol), 4,4'-sec-butylidene diphenol, 4,4'-cyclohexylidene bisphenol, 4,4'-cyclohexylidene bis(2-methyl phenol), 4-tert-butylphenol, 4-phenylphenol, 4-hydroxy diphenoxide, α-naphthol, β-naphthol, 3,5-xylenol, thymol, methyl-4-hydroxybenzoate, 4-hydroxyacetophenone, novolak phenol resin, 2,2'-thiobis(4,6-dichlorophenol), catechol, resorcin, hydroquinone, pyrogallol, fluoroglycine, fluoroglycine carboxylic acid, 4-tert-octylcatechol, 2,2'-methylenebis(4-chlorophenol), 2,2'-methylenebis(4-methyl-6-tert-butylphenol), 2,2'-dihydroxydiphenyl, ethyl p-hydroxy benzoate, propyl p-hydroxy benzoate, butyl p-hydroxy benzoate, benzyl p-hydroxy benzoate, p-chlorobenzyl-p-hydroxy benzoate, o-chlorobenzyl-p-hydroxy benzoate, p-methyl benzyl-p-hydroxy benzoate, n-octyl-p-hydroxy benzoate, benzoic acid, zinc salicylate, 1-hydroxy-2-naphthoic acid, 2-hydroxy-6-naphthoic acid, zinc 2-hydroxy-6-naphthoate, 4-hydroxydiphenyl sulfone, 4-hydroxy-4'-chlorodiphenyl sulfone, bis(4-hydroxyphenyl)sulfide, 2-hydroxy-p-toluic acid, zinc 3,5-di-tert-butylsalicylate, tin 3,5-di-tert-butylsalicylate, tartaric acid, oxalic acid, maleic acid, citric acid, succinic acid, stearic acid, 4-hydroxyphthalic acid, boric acid, thiourea derivatives, 4-hydroxythiophenol derivatives, bis(4-hydroxyphenyl) acetic acid, ethyl bis(4-hydroxyphenyl)acetate, n-propyl-bis(4-hydroxyphenyl)acetate, n-butyl-bis(4-hydroxyphenyl)acetate, phenyl bis(4-hydroxyphenyl)acetate, benzyl bis(4-hydroxyphenyl)acetate, phenethyl bis(4-hydroxyphenyl)acetate, bis(3-methyl-4-hydroxyphenyl) acetic acid, methyl bis(3-methyl-4-hydroxyphenyl)acetate, n-propyl-bis(3-methyl-4-hydroxyphenyl)acetate, 1,7-bis(4-hydroxyphenylthio)-3,5-dioxaheptane, 1,5-bis(4-hydroxyphenylthio)-3-oxaheptane, dimethyl 4-hydroxy phthalate, 4-hydroxy-4'-methoxydiphenyl sulfone, 4-hydroxy-4'-ethoxydiphenyl sulfone, 4-hydroxy-4'-isopropxydiphenyl sulfone, 4-hydroxy-4'-propxydiphenyl sulfone, 4-hydroxy-4'-butoxydiphenyl sulfone, 4-hydroxy-4'-isopropxydiphenyl sulfone, 4-hydroxy-4'-sec-butoxydiphenyl sulfone, 4-hydroxy-4'-tert-butoxydiphenyl sulfone, 4-hydroxy-4'-benzyloxydiphenyl sulfone, 4-hydroxy-4'-phenoxydiphenyl sulfone, 4-hydroxy-4'-(m-methyl benzyloxy)diphenyl sulfone, 4-hydroxy-4'-(p-methyl benzyloxy)diphenyl sulfone, 4-hydroxy-4'-(o-methyl benzyloxy) diphenyl sulfone, 4-hydroxy-4'-(p-chlorobenzyloxy)diphenyl sulfone, and 4-hydroxy-4'-oxyallyldiphenyl sulfone. These may be used independently or in combination.

A mixing ratio between the leuco dye and the developing agent in the thermosensitive coloring layer is appropriately selected depending on the intended purpose without any limitation, but is preferably 0.5 parts by mass to 10 parts by mass of the developing agent relative to 1 part of the leuco dye in view of coloring density, more preferably 1 part by mass to 5 parts by mass of the developing agent relative to 1 part by mass of the leuco dye.

-Other Components-

Other components are appropriately selected depending on the intended purpose without any limitation, and examples thereof include a binding agent, filler, a thermoplastic material, a crosslinking agent, a pigment, a surfactant, a fluorescent brightener, and a lubricant. These may be used independently or in combination, --Binding Agent--

The binding agent is appropriately selected depending on the intended purpose without any limitation, provided that it improves coating ability of a layer, and binding ability, and examples thereof include starches, hydroxyethyl cellulose, methyl cellulose, carboxymethyl cellulose, gelatine, casein, Arabian gum, polyvinyl alcohol, a salt of a diisobutylene-maleic anhydride copolymer, a salt of a styrene-maleic anhydride copolymer, a salt of an ethylene-acrylic acid copolymer, a salt of a styrene-acryl copolymer, and emulsion of a salt of a styrene-butadiene copolymer.

--Filler--

The filler is appropriately selected depending on the intended purpose without any limitation, and examples thereof include inorganic pigments (e.g., calcium carbonate, aluminum oxide, zinc oxide, titanium dioxide, silica, aluminum hydroxide, barium sulfate, talc, kaolin, alumina, and clay), and organic pigments known in the art.

Among them, silica, alumina and kaolin, which are acid pigments, are preferable in view of their water resistance, and silica is more preferable in view of its coloring density.

--Thermoplastic Material--

The thermoplastic material is appropriately selected depending on the intended purpose without any limitation, provided that it is a material dissolved at temperature of 80° C. or higher, and examples thereof include fatty acid, fatty acid amide, N-substituted amide, bisfatty acid amide, hydroxyfatty acid amide, fatty acid metal salts, p-benzyl biphenyl, terphenyl, triphenyl methane, benzyl p-benzyloxy benzoate, β-benzyloxy naphthalene, phenyl β-naphthoate, phenyl 1-hydroxy-2-naphthoate, methyl 1-hydroxy-2-naphthoate, diphenylcarbonate, benzyl terephthalate, 1,4-dimethoxynaphthalene, 1,4-dimethoxynaphthalene, 1,4-dibenzyloxy naphthalene, 1,2-diphenoxy ethane, 1,2-bis(4-methyl phenoxyethane), 1,4-diphenoxy-2-butene, 1,2-bis(4-methoxyphenylthio)ethane, dibenzoylmethane, 1,4-diphenylthiobutane, 1,4-diphenylthio-2-butene, 1,3-bis(2-vinyloxyethoxy)benzene, 1,4-bis(2-vinyloxyethoxy) benzene, p-(2-vinyloxyethoxy)biphenyl, p-aryloxybiphenyl, dibenzoyloxy methane, dibenzoyloxy propane, dibenzyl disulfide, 1,1-diphenylethanol, 1,1-diphenylpropanol, p-benzyloxybenzyl alcohol, 1,3-phenoxy-2-propanol, N-octadecyl carbamoyl-p-methoxycarbonylbenzene, N-octadecyl carbamoyl benzene, 1,2-bis(4-methoxyphenoxy)propane, 1,5-bis(4-methoxyphenoxy)-3-oxapentane, dibenzyl oxalate, bis (4-methylbenzyl) oxalate, and bis(4-chlorobenzyl) oxalate.

The fatty acid is appropriately selected depending on the intended purpose without any limitation, and examples thereof include stearic acid, and behenic acid.

The fatty acid amide is appropriately selected depending on the intended purpose without any limitation, and examples thereof include stearic amide, euracamide, palmitic amide, and behenic amide.

The N-substituted amide is appropriately selected depending on the intended purpose without any limitation, and examples thereof include N-lauryl lauric amide, N-stearyl stearic acid, and N-oleyl stearic amide.

The bisfatty acid amide is appropriately selected depending on the intended purpose without any limitation, and examples thereof include methylene bisstearic amide, ethylene bisstearic amide, ethylene bislauric amide, ethylene biscapric amide, and ethylenebisbehenic amide.

The hydroxyl fatty acid amide is appropriately selected depending on the intended purpose without any limitation, and examples thereof include hydroxyl stearic amide, methylene bishydroxy stearic amide, ethylene bishydroxy stearic amide, and hexamethylene bishydroxy stearic amide.

The fatty acid metal salt is appropriately selected depending on the intended purpose without any limitation, and examples thereof include zinc stearate, aluminum stearate, calcium stearate, zinc palmitate, and zinc behenate.

--Crosslinking Agent--

The crosslinking agent is appropriately selected depending on the intended purpose without any limitation. In the case where the barrier layer contains the aforementioned polyvinyl alcohol containing a reactive carbonyl group, it is easy to induce a crosslink reaction when N-aminopolyacryl amide is contained as a crosslinking agent at least either in the barrier layer, or in the thermosensitive coloring layer, which is preferred because water resistance can be improved without adding other crosslinking agents that may inhibit coloring.

--Pigment--

The pigment is appropriately selected depending on the intended purpose without any limitation, but it is preferably a white pigment in order to improve contrast of an image.

---White Pigment---

The white pigment is appropriately selected depending on the intended purpose without any limitation, and examples thereof include kaolin, clay, silica, magnesium carbonate, and calcium carbonate. These may be used independently or in combination.

--Fluorescent Brightener--

The fluorescent brightener is appropriately selected depending on the intended purpose without any limitation, but it is preferably a diaminostilbene-based compound because such compound has an effect of improving back ground whiteness, and has stability with a coating liquid of a barrier layer.

A method for forming the thermosensitive coloring layer is appropriately selected depending on the intended purpose without any limitation. For example, the thermosensitive coloring layer can be formed by preparing a thermosensitive coloring layer coating liquid in the following manner, and applying the thermosensitive coloring layer coating liquid onto the base. The thermosensitive coloring layer coating liquid is prepared by crushing and dispersing the leuco dye and the developing agent together with a binding agent and/or other components by means of a disperser, such as a ball mill, attritor, and sand mill, to give dispersed particle diameters of 1 μm to 3 μm, followed by mixing optionally with filler and thermoplastic material (a sensitizing agent) dispersion liquids in a certain formula.

The average thickness of the thermosensitive coloring layer is appropriately selected depending on the intended purpose without any limitation, but it is preferably 1 μm to 50 μm, more preferably 3 μm to 20 μm, in view of coloring density.

<Base>

The base is appropriately selected depending on the intended purpose without any limitation.

-Shape, Etc., of Base-

A shape of the base is appropriately selected depending on the intended purpose without any limitation, and examples thereof include shapes of a plate, a sheet, and a film.

A structure of the base is appropriately selected depending on the intended purpose without any limitation, and examples thereof include a single layer structure, and a laminate structure.

A size of the base is appropriately selected depending on the intended purpose without any limitation, and for example, the size thereof is appropriately selected depending on a size of the thermosensitive coloring layer, or the like.

The average thickness of the base is appropriately selected depending on the intended purpose without any limitation, but it is preferably 50 μm to 2,000 μm, more preferably 100 μm to 1,000 μm, in view of convenience.

A material of the base is appropriately selected depending on the intended purpose without any limitation, and examples thereof include an inorganic material, and an organic material.

-Inorganic Material-

The inorganic material is appropriately selected depending on the intended purpose without any limitation, and examples thereof include glass, quartz, silicon oxide, and aluminum oxide.

-Organic Material-

The organic material is appropriately selected depending on the intended purpose without any limitation, and examples thereof include paper, and a resin.

--Paper--

The paper is appropriately selected depending on the intended purpose without any limitation, and examples thereof include wood free paper, art paper, coat paper, and synthetic paper.

Among them, wood free paper and art paper are preferable in view of the cost.

--Resin--

The resin is appropriately selected depending on the intended purpose without any limitation, and examples thereof include a cellulose derivative, polyester, polycarbonate, polystyrene, polymethyl methacrylate, polyethylene, and polypropylene.

The cellulose derivative is appropriately selected depending on the intended purpose without any limitation, and examples thereof include cellulose triacetate.

The polyester is appropriately selected depending on the intended purpose without any limitation, and examples thereof include polyethylene terephthalate (PET), and polybutylene terephthalate.

The base is preferably subjected to a surface modification, such as by corona discharging, oxidation reaction (chromic acid etc.), etching, a treatment for adhesion, and anti-static treatment, for the purpose of improving adhesion of a coating layer. Moreover, the paper is preferably colored in white by adding thereto a white pigment, such as titanium oxide.

<Adhesive Layer>

An adhesive for use in the adhesive layer is appropriately selected depending on the intended purpose without any limitation, but it is preferably acryl-based emulsion in view of safety, quality, and cost. In the case of the acryl-based emulsion used as the adhesive, a thickener used for adjusting a fluid viscosity of the adhesive is preferably a similar type of polyacrylate that will not adversely affect the adhesion properties of the adhesive.

Since the polyacrylic acid has a small molecular weight compared with that of the adhesive and tends to move, a carboxyl group (—COOH), which is a functional group of the polyacrylic acid, is likely to orientated to an interface of the adhesive layer, which increases bonding strength by bonding to the reactive silicon (═SiH), which is remained in the organohydrogen polysiloxane in the release layer due to insufficient crosslinking.

Therefore, an amount of the polyacrylic acid contained is adjusted as small as possible. In view of coating ability, however, adjustment in viscosity of the adhesive is required. For this reason, use of an adhesive composed of acryl emulsion containing 1.0% by mass to 3.0% by mass of the polyacrylic acid is preferable, and the viscosity of the adhesive is adjusted by adjusting stirring time with the aforementioned range of the amount of the polyacrylic acid. Use of such adhesive realizes reduction in variation of the binding strength between the release layer and the adhesive layer over time.

The viscosity of the adhesive is appropriately selected depending on the intended purpose without any limitation, but it is preferably 15,000 mPa·s±5,000 mPa·s, more preferably 15,000 mPa·s±3,000 mPa·s in view of coatability. When the viscosity is lower than 10,000 mPa·s, air bubbles tend to be included during coating, which tends to leave lines from coating. When the viscosity is greater than 20,000 mPa·s, a coating surface becomes uneven, which may adversely affect adhesion properties.

A coating method of the adhesive is appropriately selected depending on the intended purpose without any limitation, and examples thereof include bar coating, roll coating, comma coating, and gravure coating.

An amount of the adhesive in the adhesive layer is appropriately selected depending on the intended purpose without any limitation, but it is preferably 10 g/m$^2$ to 25 g/m$^2$ because a resulting adhesive layer can stably exhibit adhesion regardless of a surface configuration of a subject to which a resulting thermosensitive recording label is adhered, and floating of the label is prevented even when the label is adhered to a subject, such as a cardboard box. When the amount thereof is smaller than 10 g/m$^2$, the adhesive cannot over a surface of a cardboard box when a subject has rough surface such as the cardboard box, and therefore adhesion of the label is extremely low. When the amount thereof is greater than 25 g/m$^2$, especially in the case where the label is in the form of a roll, the adhesive may bleed out, and a problem in terms of cost may occur.

<Other Layers>

Other layers are appropriately selected depending on the intended purpose without any limitation, and examples thereof include an image adjustment layer provided on an opposite surface (back surface) to a surface of the base where the thermosensitive coloring layer is provided.

The image adjustment layer may contain other components, such as organic filler, and a lubricant.

-Image Adjustment Layer-

The image adjustment layer has a function of protecting an image of the thermosensitive recording label, and a function of adjusting contrast of the image.

The image adjustment layer is appropriately selected depending on the intended purpose without any limitation, but the image adjustment layer preferably contains a pigment, and a cured product of a water-soluble resin with a crosslinking agent.

--Pigment--

The pigment is appropriately selected depending on the intended purpose without any limitation, but it is preferably a white pigment because of its ability of adjusting contrast of an image.

---White Pigment---

The white pigment is appropriately selected depending on the intended purpose without any limitation, and examples thereof include those usable in the thermosensitive coloring layer.

--Water-Soluble Resin--

The water-soluble resin is appropriately selected depending on the intended purpose without any limitation, and examples thereof include polyvinyl alcohol, starch and derivatives thereof, a cellulose derivative (e.g., methoxy cellulose, hydroxyethyl cellulose, carboxymethyl cellulose, methyl cellulose, and ethyl cellulose, sodium polyacrylate, polyvinyl pyrrolidone, an acryl amide-acrylic acid ester copolymer, an acryl amide-acrylic acid ester-methacrylic acid terpolymer, an alkali salt of a styrene/maleic anhydride copolymer, an alkali salt of an isobutylene-maleic anhydride copolymer, polyacryl amide, sodium alginate, gelatine, and casein. These may be used independently or in combination. Among them, it is preferred that the water-soluble resin be used in the state of polymer emulsion in view of easiness in coating on the image adjustment layer.

---Polymer Emulsion---

The polymer emulsion is appropriately selected depending on the intended purpose without any limitation, and examples thereof include latex of an acrylic acid ester copolymer, a styrene-butadiene copolymer, or a styrene-butadiene-acryl-based copolymer, and emulsion of a vinyl acetate resin, a vinyl acetate-acrylic acid copolymer, a styrene-acrylic acid ester copolymer, an acrylic acid ester resin, or a polyurethane resin. These may be used independently or in combination.

--Crosslinking Agent--

The crosslinking agent is appropriately selected depending on the intended purpose without any limitation, and examples thereof include those usable in the barrier layer.

--Organic Filler--

The organic filler is appropriately selected depending on the intended purpose without any limitation, and examples thereof include a silicone resin, a cellulose resin, an epoxy resin, a nylon resin, a phenol resin, a polyurethane resin, a urea resin, a melamine resin, a polyester resin, a polycarbonate resin, a styrene-based resin, an acryl-based resin, a polyethylene resin, a formaldehyde-based resin, and a polymethyl methacrylate resin. These may be used independently or in combination.

A method for forming the image adjustment layer is appropriately selected depending on the intended purpose without any limitation, but it is preferably a method in which a coating liquid of an image adjustment layer is applied onto a base by coating to form the image adjustment layer.

The coating method of the image adjustment layer is appropriately selected depending on the intended purpose without any limitation, and examples thereof include spin coating, dip coating, kneader coating, curtain coating, and blade coating.

The average thickness of the image adjustment layer is appropriately selected depending on the intended purpose without any limitation, but it is preferably 0.1 μm to 10 μm, more preferably 0.5 μm to 5 μm, in view of coloring sensitivity.

<Structure of Thermosensitive Recording Label>

A structure of the thermosensitive recording label can be appropriately selected without any limitation, and examples thereof include in the form of a roll, a sheet, and a film. Among them, a roll is particularly preferable in view of convenience.

EXAMPLES

The present invention will be more specifically explained through Examples and Comparative Examples hereinafter, but these Examples shall not be construed as limiting the scope of the present invention. Moreover, "part(s)" and "%" described in each Example respectively represent "part(s) by mass" and "% by mass" unless otherwise stated.

Example A1

Production of Thermosensitive Recording Label (1) Preparation of Under Layer Coating Liquid

[Liquid A]

| | |
|---|---|
| Calcined kaolin | 36 parts |
| Styrene-butadiene copolymer latex (product name: SMARTEX PA-9159, manufactured by Nippon A & L Inc., solid concentration: 47.5%) | 10 parts |
| Water | 54 parts |

(2) Preparation of Thermosensitive Coloring Layer Coating Liquid

[Liquid B]

| | |
|---|---|
| 2-anilino-3-methyl-6-(di-n-butylamino)fluoran | 20 parts |
| 10% aqueous solution of itaconic acid-modified polyvinyl alcohol (modification rate: 1 mol %) | 20 parts |
| Water | 60 parts |

[Liquid C]

| | |
|---|---|
| 4-hydroxy-4'-isopropxydiphenyl sulfone | 20 parts |
| 10% aqueous solution of itaconic acid-modified polyvinyl alcohol (modification rate: 1 mol %) | 20 parts |
| Silica | 10 parts |
| Water | 50 parts |

[Liquid D]

Liquid B and Liquid C each formed of the aforementioned formulation were each dispersed by means of a sand mill to have the average particle diameter of 1.0 μm or smaller, to thereby prepare a dye dispersion liquid, Liquid B, and a developing agent dispersion liquid, Liquid C, respectively.

Subsequently, Liquid B and Liquid C were mixed a ratio (mass ratio) of 1:7, and the solid concentration of the mixture was adjusted to 25%, and was stirred, to thereby prepare a thermosensitive coloring layer coating liquid, Liquid D.

(4) Preparation of Barrier Layer Coating Liquid

[Liquid E-1]

| | |
|---|---|
| Calcined kaolin | 20 parts |
| 10% aqueous solution of itaconic acid-modified polyvinyl alcohol (K POLYMER KL-318, manufactured by Kuraray Co., Ltd., modification rate: 1 mol %) | 20 parts |
| Water | 60 parts |

The materials of the formulation above were dispersed for 24 hours by means of a sand mill, to thereby prepare Liquid E-1.

[Liquid F-1]

| | |
|---|---|
| Liquid E-1 | 75 parts |
| 10% aqueous solution of deacetone-modified polyvinyl alcohol (DM-17, manufactured by JAPAN VAM POVAL CO., LTD., modification rate: 4 mol %) | 100 parts |
| 10% aqueous solution of adipic dihydrazide | 10 parts |
| Water | 90 parts |

The materials of the formulation above were mixed and stirred to thereby prepare a barrier layer coating liquid, Liquid F-1.

(5) Preparation of Release Layer Coating Liquid

[Liquid G]

| | |
|---|---|
| Vinyl group-containing heat curing silicone resin (BY24-468C, manufactured by Dow Corning Toray Co., Ltd.) | 100 parts |
| Curing catalyst (SRX212, manufactured by Dow Corning Toray Co., Ltd.) | 3.0 parts |

The materials of the formulation above were mixed to thereby prepare Liquid F.

Onto a surface of base paper (wood free paper having a basis weight of about 60 g/m$^2$), the under layer coating liquid, Liquid A, was applied by blade coating to give a dry deposition amount of 3.0 g/m$^2$, and then was dried, to thereby form an under layer.

Next, onto the under layer, the thermosensitive coloring layer coating liquid, Liquid D, and the barrier layer coating liquid, Liquid F-1 were successively applied and laminated to give dry deposition amounts of 5.0 g/m$^2$, and 1.0 g/m$^2$, respectively, followed by drying to thereby form a thermosensitive coloring layer, and a barrier layer. Thereafter, calendering was performed to give a surface with Oken-type smoothness of about 2,000 seconds.

Next, the release layer coating liquid, Liquid G, was applied onto the barrier layer by coating to give a dry mass of 1.0 g/m$^2$, followed by drying at temperature and time period by which the thermosensitive coloring layer would not color, by means of a dryer box (dryer EHT-6025, of ETAC), to thereby cure the release layer. As a result, a thermosensitive recording material provided with the release layer was obtained. The curing state of the release layer was determined as a non-liquid state when touching a release layer with fingers.

(6) Formation of Adhesive Layer

Next, an acrylic adhesive (manufactured by Henkel Japan Ltd., solid concentration: 54%) was applied onto a surface of a base opposite to the surface thereof where the release layer of the thermosensitive recording material had been provided, to give a dry mass of 20 g/m$^2$. After drying the applied acrylic adhesive, the resultant was wound into a roll in the manner that the release layer and the adhesive layer were bonded to each other, to thereby produce a thermosensitive recording label of Example A1.

Example A2

Production of Thermosensitive Recording Label

A thermosensitive recording label of Example A2 was produced in the same manner as in Example A1, provided that calcined kaolin contained in Liquid A of the under layer coating liquid was replaced with vinylidene chloride-acrylonitrile copolymer particles (molar ratio of vinylidene chloride/acrylonitrile=6/4), which had a solid content concentration of 27.5%, the average particle diameter of 3 and a void ratio of 90%.

Example A3

Production of Thermosensitive Recording Label

A thermosensitive recording label of Example A3 was produced in the same manner as in Example A2, provided that the vinyl group—containing heat curing silicone resin (BY24-468C, manufactured by Dow Corning Toray Co., Ltd.) contained in the release layer coating liquid, Liquid G, was replaced with a hexenyl group-containing heat curing silicone resin (LTC1056L, manufactured by Dow Corning Toray Co., Ltd.).

Example A4

Production of Thermosensitive Recording Label

A thermosensitive recording label of Example A4 was produced in the same manner as in Example A3, provided that the barrier layer coating liquid, Liquid F-1, was replaced with Liquid F-2 described below.

[Liquid F-2]

| | |
|---|---|
| Liquid E-1 | 75 parts |
| 10% aqueous solution of itaconic acid-modified polyvinyl alcohol (modification rate: 1 mol %) | 100 parts |
| 10% aqueous solution of adipic dihydrazide | 10 parts |
| Water | 90 parts |

The materials presented above were mixed and stirred to thereby prepare a barrier layer coating liquid, Liquid F-2.

Example A5

Production of Thermosensitive Recording Label

A thermosensitive recording label of Example A5 was produced in the same manner as in Example A4, provided that Liquid E-1 was replaced with Liquid E-2 described below.

[Liquid E-2]

| | |
|---|---|
| Aluminum hydroxide. | 20 parts |
| 10% aqueous solution of itaconic acid-modified polyvinyl alcohol (modification rate: 1 mol %) | 20 parts |
| 10% aqueous solution of polyamide-epichlorohydrin resin | 10 parts |
| Water | 60 parts |

The materials of the formulation above were dispersed for 24 hours by means of a sand mill to thereby prepare Liquid E-2.

Example A6

Production of Thermosensitive Recording Label

A thermosensitive recording label of Example A6 was produced in the same manner as in Example A5, provided that the barrier layer coating liquid, Liquid F-2, was replaced with Liquid F-3 presented below.

[Liquid H]

| | |
|---|---|
| Spherical silicone resin particles (KMP-590, manufactured by Shin-Etsu Chemical Co., Ltd., volume average particle diameter: 2.0 μm). | 30 parts |
| 10% aqueous solution of alkyl sulfosuccinate | 10 parts |
| Water | 60 parts |

The materials of the formulation above were stirred with a stirrer for 1 hour, to thereby prepare Liquid H.

[Liquid F-3]

| | |
|---|---|
| Liquid E-2 | 75 parts |
| Liquid H | 5 parts |
| 10% aqueous solution of itaconic acid-modified polyvinyl alcohol (modification rate: 1 mol %) | 100 parts |
| 10% aqueous solution of polyamide-epichlorohydrin resin | 10 parts |
| Water | 90 parts |

The materials of the formulation above were mixed and stirred to thereby prepare a barrier layer coating liquid, Liquid F-3.

Comparative Example A1

Production of Thermosensitive Recording Label

A thermosensitive recording label of Comparative Example A1 was produced in the same manner as in Example A1, provided that the barrier layer coating liquid, Liquid F-1, was replaced with Liquid F-4 described below.

[Liquid F-4]

| | |
|---|---|
| Styrene-butadiene copolymer latex (product name: SMARTEX PA-9159, manufactured by Nippon A & L Inc., solid concentration: 47.5%) | 21 parts |
| Water | 79 parts |

The materials of the formulation above were mixed and stirred to thereby prepare a barrier layer coating liquid, Liquid F-4.

Comparative Example A2

Production of Thermosensitive Recording Label

A thermosensitive recording label of Comparative Example A2 was produced in the same manner as in Example A1, provided that the barrier layer coating liquid, Liquid F-1, was replaced with Liquid F-5 described below.

[Liquid F-5]

| | |
|---|---|
| 10% aqueous solution of itaconic acid-modified polyvinyl alcohol (modification rate: 1 mol %) | 50 parts |
| 10% aqueous solution of polyamide-epichlorohydrin resin | 5 parts |
| Water | 45 parts |

The materials of the formulation above were mixed and stirred, to thereby prepare a barrier layer coating liquid, Liquid F-5.

Comparative Example A3

Production of Thermosensitive Recording Label

A thermosensitive recording label of Comparative Example A3 was produced in the same manner as in Example A2, provided that Liquid G was replaced with Liquid G-2, and a release layer was provided by applying Liquid G-2 to give a dry mass of 1.0 g/m$^2$, followed by applying ultraviolet rays twice by means of an ultraviolet ray irradiation device (device name: TOSURE 2000, model name: KUV-20261-1X, product of TOSHIBA DENZAI CO., LTD.) in the entire lighting state (at 10 ampere to 12 ampere measured by an ammeter) and at an irradiation speed of 5 m/min, to thereby cure the release layer coating

[Liquid G-2]

| | |
|---|---|
| UV curing silicone resin [a mixed composition of 30 part of mercapto group-containing (1.5 mol %) organopolysiloxane and 70 parts of vinyl group-containing (1.5 mol %) organopolysiloxane] (manufactured by Shin-Etsu Chemical Co., Ltd.) | 100 parts |
| Curing catalyst (acetophenone) | 3.0 parts |

TABLE A1

| | | Barrier layer | | | |
|---|---|---|---|---|---|
| | Release layer | Water-soluble resin | Inorganic filler | Resin particles | Under layer Filler |
| Ex. A1 | vinyl group-containing heat curing silicone resin | diacetone-modified polyvinyl alcohol | calcined kaolin | — | calcined kaolin |
| Ex. A2 | vinyl group-containing heat curing silicone resin | diacetone-modified polyvinyl alcohol | calcined kaolin | — | vinylidne chloride-acrylonitrile copolymer |
| Ex. A3 | hexenyl group-containing heat curing silicone resin | diacetone-modified polyvinyl alcohol | calcined kaolin | — | vinylidne chloride-acrylonitrile copolymer |
| Ex. A4 | hexenyl group-containing heat curing silicone resin | itaconic acid-modified polyvinyl alcohol | calcined kaolin | — | vinylidne chloride-acrylonitrile copolymer |
| Ex. A5 | hexenyl group-containing heat curing silicone resin | itaconic acid-modified polyvinyl alcohol | aluminum hydroxide | — | vinylidne chloride-acrylonitrile copolymer |
| Ex. A6 | hexenyl group-containing heat curing silicone resin | itaconic acid-modified polyvinyl alcohol | aluminum hydroxide | silicone resin particles | vinylidne chloride-acrylonitrile copolymer |
| Comp. Ex. A1 | vinyl group-containing heat curing silicone resin | styrene-butadiene copolymer latex | none | — | calcined kaolin |
| Comp. Ex. A2 | vinyl group-containing heat curing silicone resin | itaconic acid-modified polyvinyl alcohol | none | — | calcined kaolin |
| Comp. Ex. A3 | UV curing silicone resin | Diacetone-modified polyvinyl alcohol | calcined kaolin | — | vinylidne chloride-acrylonitrile copolymer |

Various properties of thermosensitive recording labels obtained in the aforementioned manner were each evaluated. The results are presented in Table A2.

<Peal Property>

Two thermosensitive recording labels in the laminate state was cut into a size of 4 cm×20 cm, and a pealing property was evaluated when the upper label and the lower label were pealed from each other by hand with a pealing angle of 90°.

The evaluation was performed just after the production of sample (initial stage) and after left to stand for 3 months (Over time).

[Evaluation Criteria]

A: Pealed easily and without any problem

B: Pealed with some resistance, but without any problem

C: Pealed with some resistance

D: Peeled with significant resistance

<Binding Ability>

The following procedure was carried out on each thermosensitive recording label. About one minute after coating and heat curing of a release layer before the formation of an adhesive layer thereon, a surface of the release layer was strongly rubbed with a finger ten times. A degree of the release layer peeled was evaluated. The evaluation criteria of the peel Test of the Release Layer are as Follows.

[Evaluation Criteria]

A: The release layer was not peeled at all.

B: The glossiness of the area where was rubbed was slightly lowered.

C: Peeling was confirmed at a very small part in the area where was rubbed.

D: Peeling occurred.

<Evaluation on Sticking in Low Temperature Low Humidity Environment>

Each thermosensitive recording label and a printer (L'esprit R-12, manufactured by Saton Inc.) was left to stand for 1 hour in the low temperature and low humidity environment of 5° C., 30% RH, to adjust the moisture, followed by carried out printing. Then, sticking during the printing was evaluated.

In the case where anti-sticking property is excellent, a printing pattern is accurately printed. In the case where anti-sticking property is not excellent, on the other hand, a printing pattern is not accurately printed because printing is performed and superimposed on the same area of the thermosensitive recording label. The printed image was visually observed, and the sticking was evaluated based on the following criteria. Note that, the sticking was evaluated in the low temperature environment, because the sticking tends to occur in the low temperature environment compared to in the moderate to high temperature environment, due to a temperature difference between the label and a thermal head.

[Ranks of Sticking by Visual Observation (5 Standards)]

A: No sticking occurred.

B: Sticking slightly occurred to the level which was not a problem in the quality of the image.

C: Sticking occurred to the level which was a problem in the quality of the image.

D: The level was not conveyed perfectly and sticking occurred.

E: The level was not conveyed at all.

<Sensitivity Scale Factor>

Each thermosensitive recording label was printed by means of a thermosensitive print testing device having a thin film head, manufactured by Panasonic Electronic Device Inc., under the following conditions, which were a heat power of 0.45 W/dot, 1-line recording time of 20 msec/L, scanning density of 8×385 dot/mm. The printing was performed with a pulse width of 0.2 msec to 1.2 msec per 0.1 msec. The print density was measured by Macbeth Densitometer RD-914, and the pulse width with which the density was 1.0 was calculated.

Taking Comparative Example A1 as a standard, a sensitivity scale factor was calculated using the following equation. The greater the value is, more excellent the sensitivity (thermal response) is.

Sensitivity scale factor=(pulse width of Comparative Example *A*1)/(pulse width of measured sample)

TABLE A2

| | Evaluation results | | | | |
|---|---|---|---|---|---|
| | Peel force | | Release layer binding | Low temperature | Sensitivity |
| | Initial | Over time | ability | sticking | scale factor |
| Ex. A1 | B | B | C | C | 1.00 |
| Ex. A2 | B | B | B | C | 1.05 |
| Ex. A3 | A | B | B | C | 1.07 |
| Ex. A4 | A | A | B | C | 1.09 |
| Ex. A5 | A | A | A | B | 1.09 |
| Ex. A6 | A | A | A | A | 1.10 |
| Comp. Ex. A1 | D | D | D | E | 1.00 |
| Comp. Ex. A2 | C | C | D | D | 1.00 |
| Comp. Ex. A3 | B | D | C | C | 1.00 |

Examples A1 to A6, in each of which the water-soluble resin of the barrier layer was polyvinyl alcohol containing a reactive carbonyl group, unlikely had residues of uncured silicone resin in their release layer, and therefore they had excellent peel force. In contrary, as Comparative Example A1 used the styrene-butadiene copolymer latex, curing of the silicone resin in the release layer was inhibited, leaving residues of the uncured silicone resin, which adhered to the adhesive. As a result, the peel force was not desirable.

Example B1

Production of Thermosensitive Recording Label (1) Preparation of Under Layer Coating Liquid

[Liquid A]

| | |
|---|---|
| Calcined kaolin (product name: Ultra White 90, manufactured by BASF Corporation) | 36 parts |
| Styrene-butadiene copolymer latex (product name: SMARTEX PA-9159, manufactured by Nippon A & L Inc., solid concentration: 47.5%). | 10 parts |
| Water | 54 parts |

(2) Preparation of Thermosensitive Coloring Layer Coating Liquid

[Liquid B]

| | |
|---|---|
| 2-anilino-3-methyl-6-(di-n-butylamino)fluoran | 20 parts |
| 10% aqueous solution of itaconic acid-modified polyvinyl alcohol (modification rate: 1 mol %) (product name: Kuraray K Polymer KL-318, manufactured by Kuraray Co., Ltd.) | 20 parts |
| Water | 60 parts |

[Liquid C]

| | |
|---|---|
| 4-hydroxy-4'-isopropxydiphenyl sulfone | 20 parts |
| 10% aqueous solution of itaconic acid-modified polyvinyl alcohol (modification rate: 1 mol %) (product name: Kurary K Polymer KL-318, manufactured by Kuraray Co., Ltd.). | 20 parts |
| Silica (product name: MIZUKASIL P-603, manufactured by MIZUSAWA INDUSTRIAL CHEMICALS, LTD.).. | 10 parts |
| Water | 50 parts |

[Liquid D]

Liquid B and Liquid C each formed of the respective formulation above were each dispersed by means of a sand mill to give the average particle diameter of 1.0 μm or smaller, to thereby prepare a dye dispersion liquid, Liquid B, and a developing agent dispersion liquid. Liquid C.

Subsequently, Liquid B and Liquid C were mixed at a ratio of 1 part/7 parts, and a solid content of the mixture was adjusted to 25%, followed by stirring, to thereby prepare a thermosensitive coloring layer coating liquid, Liquid D.

(3) Preparation of Barrier Layer Coating Liquid

[Liquid E-1]

| | |
|---|---|
| Calcined kaolin (product name: Ultra White 90, manufactured by BASF Corporation). | 20 parts |
| 10% aqueous solution of itaconic acid-modified polyvinyl alcohol (modification rate: 1 mol %) (product name: Kuraray K Polymer KL-318, manufactured by Kuraray Co., Ltd.) | 20 parts |
| Water | 60 parts |

The materials of the formulation above were dispersed for 24 hours by means of a sand mill, to thereby prepare Liquid E-1.

[Liquid F-1]

| | |
|---|---|
| Liquid E-1 | 75 parts |
| Non-porous crosslinked polymethyl methacrylate particles (product name: GM-0105, manufactured by GANZ CHEMICAL CO., LTD.) having the volume average particle diameter of 2.0 μm, and the bulk density of 0.50 g/mL. | 5 parts |
| 10% aqueous solution of diacetone-modified polyvinyl alcohol (modification rate: 4 mol %) (product name: DM-17, manufactured by JAPAN VAM POVAL CO., LTD.) | 100 parts |
| 10% aqueous solution of adipic dihydrazide | 10 parts |
| Water | 85 parts |

The materials of the formulation above were mixed and stirred to prepare a barrier layer coating liquid, Liquid F-1. Note that, the bulk density was determined by adding the non-porous crosslinked polymethyl methacrylate particles (product name: PM-030, manufactured by GANZ CHEMICAL CO., LTD.) having the volume average particle diameter of 0.3 μm into a measuring cylinder (100 mL in volume) up to 10 mL, measuring the mass thereof, and calculating the value of the measured mass/the measured volume.

(4) Preparation of Release Layer Coating Liquid

[Liquid G]

| | |
|---|---|
| Vinyl group-containing heat curing silicone resin (product name: BY24-468C, manufactured by Dow Corning Toray Co., Ltd.).. | 100 parts |
| Curing catalyst (product name: SRX212, manufactured by Dow Corning Toray Co., Ltd.) | 3.0 parts |

The materials of the formulation above were mixed to prepare Liquid G.

Onto a surface of base paper (wood free paper having a basis weight of about 60 g/m$^2$), the under layer coating liquid, Liquid A, was applied by blade coating to give a dry deposition amount of 3.0 g/m$^2$, and then was dried, to thereby form an under layer.

Next, onto the under layer, the thermosensitive coloring layer coating liquid, Liquid D, and the barrier layer coating liquid, Liquid F-1 were successively applied and laminated to give dry deposition amounts of 5.0 g/m$^2$, and 1.0 g/m$^2$ respectively, followed by drying to thereby form a thermosensitive coloring layer, and a barrier layer. Thereafter, calendering was performed to give a surface with Oken-type smoothness of about 2,000 seconds. The curing state of the water-soluble resin with the crosslinking agent was confirmed by HS-GC/MS.

Next, the release layer coating liquid, Liquid G, was applied onto the barrier layer by coating to give a dry mass of 1.0 g/m$^2$, followed by drying at temperature and time period by which the thermosensitive coloring layer would not color, by means of a dryer box (dryer EHT-6025, of ETAC), to thereby cure the release layer. As a result, a thermosensitive recording material provided with the release layer was obtained. The curing state of the release layer was determined as a non-liquid state when touching a release layer with fingers.

(5) Formation of Adhesive Layer

Next, an acrylic adhesive (product name: Olibin BPW6111A, manufactured by TOYOCHEM CO., LTD.) was applied onto a surface of the base opposite to the surface thereof where the release layer of the thermosensitive recording material had been provided, to give a dry mass of 20 g/m$^2$. After drying the applied acrylic adhesive, the resultant was wound into a roll in the manner that the release layer and the adhesive layer were bonded to each other, to thereby produce a thermosensitive recording label of Example B1.

Example B2

Production of Thermosensitive Recording Label

A thermosensitive recording label of Example B2 was produced in the same manner as in Example B1, provided that the crosslinked polymethyl methacrylate particles were replaced with porous crosslinked polymethyl methacrylate particles (product name: GM-0401S, manufactured by GANZ CHEMICAL CO., LTD.) having the volume average particle diameter of 2.0 μm, and the bulk density of 0.48 g/mL.

Example B3

Production of Thermosensitive Recording Label

A thermosensitive recording label of Example B3 was produced in the same manner as in Example B2, provided that the calcined kaolin (product name: Ultra White 90, manufactured by BASF Corporation) in Liquid A was replaced with vinylidene chloride-acrylonitrile copolymer (molar ratio of vinylidene chloride/acrylonitrile=6/4, solid concentration: 27.5%, volume average particle diameter: 3 μm, void ratio: 90%). Note that, the void ratio was measured by means of a scanning electron so microscope (product no.: S-3700, manufactured by Hitachi, Ltd.).

Example B4

Production of Thermosensitive Recording Label

A thermosensitive recording label of Example B4 was produced in the same manner as in Example B3, provided that the vinyl group-containing heat curing silicone resin (product name: BY24-468C, manufactured by Dow Corning Toray Co. Ltd.) in Liquid G was replaced with a heat curing silicone resin(product name: LTC1056L, manufactured by Dow Corning Toray Co., Ltd.) containing hexenyl group-containing organopolysiloxane and organohydrogen polysiloxane.

Example B5

Production of Thermosensitive Recording Label

A thermosensitive recording label of Example B5 was produced in the same manner as in Example B4, provided that the barrier layer coating liquid, Liquid F-1, was replaced with Liquid F-2 described below.

[Liquid F-2]

| | |
|---|---|
| Liquid E-1 | 75 parts |
| Porous crosslinked polymethyl methacrylate particles (product name: GM-0105, manufactured by GANZ CHEMICAL CO., LTD.) having the bulk density of 0.50 g/mL, and the volume average particle diameter of 2.0 μm | 5 parts |
| 10% aqueous solution of itaconic acid-modified polyvinyl alcohol (modification rate: 1 mol %) (product name: Kuraray K Polymer KL-318, manufactured by Kuraray Co., Ltd.). | 100 parts |
| 10% aqueous solution of adipic dihydrazide | 10 parts |
| Water | 90 parts |

The materials of the formulation above were mixed and stirred to thereby prepare a barrier layer coating liquid, Liquid F-2.

Example B6

Production of Thermosensitive Recording Label

A thermosensitive recording label of Example B6 was produced in the same manner as in Example B5, provided that Liquid E-1 was replaced with Liquid E-2 described below.

[Liquid E-2]

| | |
|---|---|
| Aluminum hydroxide. | 20 parts |
| 10% aqueous solution of itaconic acid-modified polyvinyl alcohol (modification rate: 1 mol %) (product name: Kuraray K Polymer KL-318, Kuraray Co., Ltd.) | 20 parts |
| 10% aqueous solution of polyamide-epichlorohydrin resin (product name: WS-525, manufactured by Japan PMC Corporation) | 10 parts |
| Water | 60 parts |

The materials of the formulation above were dispersed for 24 hours by means of a sand mill, to thereby prepare Liquid E-2.

Example B7

Production of Thermosensitive Recording Label

A thermosensitive recording label of Example B7 was produced in the same manner as in Example B6, provided that the crosslinked polymethyl methacrylate particles were replaced with porous crosslinked polymethyl methacrylate particles (product name: GM-0405, manufactured by GANZ CHEMICAL CO., LTD.) having the volume average particle diameter of 5.0 μm, and the bulk density of 0.50 g/mL.

Comparative Example B1

Production of Thermosensitive Recording Label

A thermosensitive recording label of Comparative Example B1 was produced in the same manner as in Example B2, provided that Liquid G was replaced with Liquid G-2 described below, and a release layer was formed by applying Liquid G-2 to give a dry mass of 1.0 g/m$^2$, followed by applying ultraviolet rays twice by means of an ultraviolet ray irradiation device (device name: TOSURE 2000, model name: KUV-20261-1X, product of TOSHIBA DENZAI CO., LTD.) in the entire lighting state (at 10 ampere to 12 ampere measured by an ammeter) and at an irradiation speed of 5 m/min, to thereby cure the release layer coating liquid.

[Liquid G2]

| | |
|---|---|
| UV curing silicone resin [mixed composition of 30 parts of a mercapto group-containing (1.5 mol %) organopolysiloxane and 70 parts of a vinyl group-containing (1.5 mol %) organopolysiloxane] (manufactured by Shin-Etsu Chemical Co., Ltd.) | 100 parts |
| Curing catalyst | 3.0 parts |

TABLE B1

| | | Barrier layer | | | | | |
|---|---|---|---|---|---|---|---|
| | | | | Crosslinked polymethyl methacrylate particles | | Under layer | |
| | Release layer | Main component of water-soluble resin | Inorganic filler | Particle size (μm) | Shape | Filler | Void ratio |
| Ex. B1 | vinyl group containing heat curing silicone resin | diacetone-modified polyvinyl alcohol | calcined kaolin | 2.0 | non-porous | calcined kaolin | 0% |

TABLE B1-continued

| | | Barrier layer | | | | | |
|---|---|---|---|---|---|---|---|
| | | Main component of | | Crosslinked polymethyl methacrylate particles | | Under layer | |
| | Release layer | water-soluble resin | Inorganic filler | Particle size (μm) | Shape | Filler | Void ratio |
| Ex. B2 | vinyl group containing heat curing silicone resin | diacetone-modified polyvinyl alcohol | calcined kaolin | 2.0 | porous | calcined kaolin | 0% |
| Ex. B3 | vinyl group containing heat curing silicone resin | diacetone-modified polyvinyl alcohol | calcined kaolin | 2.0 | porous | vinylidene chloride-acryl nitrile copolymer | 90% |
| Ex. B4 | hexenyl group containing heat curing silicone resin | diacetone-modified polyvinyl alcohol | calcined kaolin | 2.0 | porous | vinylidene chloride-acryl nitrile copolymer | 90% |
| Ex. B5 | hexenyl group containing heat curing silicone resin | itaconic acid-modified polyvinyl alcohol | calcined kaolin | 2.0 | porous | vinylidene chloride-acryl nitrile copolymer | 90% |
| Ex. B6 | hexenyl group containing heat curing silicone resin | itaconic acid-modified polyvinyl alcohol | Aluminum hydroxide | 2.0 | porous | vinylidene chloride-acryl nitrile copolymer | 90% |
| Ex. B7 | hexenyl group containing heat curing silicone resin | itaconic acid-modified polyvinyl alcohol | Aluminum hydroxide | 5.0 | porous | vinylidene chloride-amyl nitrile copolymer | 90% |
| Comp. Ex. B1 | UV-curing silicone resin | diacetone-modified polyvinyl alcohol | calcined kaolin | 2.0 | porous | calcined kaolin | 0% |

The thermosensitive recording labels obtained in the aforementioned manner were evaluated in terms of the various properties thereof in the same evaluation manner to that for Examples A1 to A6 and Comparative Examples A1 to A3. The results are presented in Table B2.

TABLE B2

| | Evaluation results | | | | |
|---|---|---|---|---|---|
| | Peel force | | Release layer | Low | |
| | Initial | Over time | binding ability | temperature sticking | sensitivity scale factor |
| Ex. B1 | B | B | C | B | 0.98 |
| Ex. B2 | B | B | B | B | 0.98 |
| Ex. B3 | B | B | B | B | 1.05 |
| Ex. B4 | A | B | B | B | 1.05 |
| Ex. B5 | A | A | B | A | 1.05 |
| Ex. B6 | A | A | A | A | 1.05 |
| Ex. B7 | A | A | A | A | 0.98 |
| Comp. Ex. B1 | B | D | C | B | 0.98 |

The embodiments of the present invention are as follows:

<1> A thermosensitive recording label, comprising:

a base:

an under layer;

a thermosensitive coloring layer;

a barrier layer;

a release layer; and an adhesive layer, where the under layer, the thermosensitive coloring layer, the barrier layer, and the release layer are disposed on one surface of the base in this order, and the adhesive layer is disposed on the other surface of the base, wherein the release layer contains a cured product of a heat curing silicone resin, and the barrier layer contains a cured product of a water-soluble resin with a crosslinking agent, and inorganic filler.

<2> The thermosensitive recording label according to <1>, wherein the heat curing silicone resin contains organopolysiloxane containing a hexenyl group, and organohydrogen polysiloxane.

<3> The thermosensitive recording label according to any of <1> or <2>, wherein the water-soluble resin is itaconic acid-modified polyvinyl alcohol.

<4> The thermosensitive recording label according to any one of <1> to <3>, wherein the inorganic filler is aluminum hydroxide.

<5> The thermosensitive recording label according to any one of <1> to <4>, wherein the barrier layer further contains resin particles.

<6> The thermosensitive recording label according to <5>, wherein the resin particles are silicone resin particles, crosslinked polymethyl methacrylate particles, or both thereof.

<7> The thermosensitive recording label according to <6>, wherein the crosslinked polymethyl methacrylate particles have a volume average particle diameter of 1.0 μm to 8.0 μm.

<8> The thermosensitive recording label according any of <6> or <7>, wherein the crosslinked polymethyl methacrylate particles are porous.

<9> The thermosensitive recording label according to any one of <1> to <8>, wherein the under layer further contains hollow thermoplastic resin particles.

<10> The thermosensitive recording label according to any one of <1> to <9>, wherein a bonding strength between the release layer and the barrier layer is stronger than a bonding strength between the adhesive layer and the release layer.

<11> The thermosensitive recording label according to any one of <1> to <10>, wherein the thermosensitive recording label in the form of a roll.

The invention claimed is:

1. A thermosensitive recording label, comprising:

a base;

an under layer;

a thermosensitive coloring layer;

a barrier layer;

a release layer; and an adhesive layer, where the under layer, the thermosensitive coloring layer, the barrier layer, and the release layer are disposed on one surface of the base in this order, and the adhesive layer is disposed on the other surface of the base, wherein the release layer contains a cured product of a heat curing silicone resin, and the barrier layer contains a cured product of a water-soluble resin with a crosslinking agent, and inorganic filler, and wherein the heat curing silicone resin contains organopolysiloxane containing a hexenyl group, and organohydrogen polysiloxane.

2. The thermosensitive recording label according to claim 1, wherein the inorganic filler is aluminum hydroxide.

3. The thermosensitive recording label according to claim 1, wherein the barrier layer further contains resin particles.

4. The thermosensitive recording label according to claim 3, wherein the resin particles are silicone resin particles, crosslinked polymethyl methacrylate particles, or both thereof.

5. The thermosensitive recording label according to claim 4, wherein the crosslinked polymethyl methacrylate particles have a volume average particle diameter of 1.0 μm to 8.0 μm.

6. The thermosensitive recording label according claim 4, wherein the crosslinked polymethyl methacrylate particles are porous.

7. The thermosensitive recording label according to claim 1, wherein the under layer further contains hollow thermoplastic resin particles.

8. The thermosensitive recording label according to claim 1, wherein a bonding strength between the release layer and the bather layer is stronger than a bonding strength between the adhesive layer and the release layer.

9. The thermosensitive recording label according to claim 1, wherein the thermosensitive recording label in the form of a roll.

10. The thermosensitive recording label according to claim 1, wherein an amount of the cured product of the water-soluble resin with the crosslinking agent in the barrier layer is from 5% by mass to 20% by mass.

11. A thermosensitive recording label, comprising:

a base;

an under layer;

a thermosensitive coloring layer;

a barrier layer;

a release layer; and an adhesive layer, where the under layer, the thermosensitive coloring layer, the barrier layer, and the release layer are disposed on one surface of the base in this order, and the adhesive layer is disposed on the other surface of the base, wherein the release layer contains a cured product of a heat curing silicone resin, and the barrier layer contains a cured product of a water-soluble resin with a crosslinking agent, and inorganic filler, wherein the water-soluble resin is itaconic acid-modified polyvinyl alcohol.

* * * * *